US006481579B2

(12) United States Patent
Kennedy

(10) Patent No.: US 6,481,579 B2
(45) Date of Patent: Nov. 19, 2002

(54) ARTICLE GRADING APPARATUS

(76) Inventor: Hamish Alexander Nigel Kennedy, 5 Watling Street, Mount Eden, Auckland (NZ)

( * ) Notice: Subject to any disclaimer, the term of this patent is extended or adjusted under 35 U.S.C. 154(b) by 0 days.

(21) Appl. No.: 09/874,176

(22) Filed: Jun. 4, 2001

(65) Prior Publication Data

US 2002/0029999 A1 Mar. 14, 2002

Related U.S. Application Data

(63) Continuation of application No. 08/809,444, filed as application No. PCT/NZ95/00113 on Nov. 1, 1995, now abandoned.

(30) Foreign Application Priority Data

Nov. 1, 1994 (NZ) ..... 264835

(51) Int. Cl.[7] ..... B07C 5/02

(52) U.S. Cl. ..... 209/539; 209/538; 209/577; 209/592; 209/912; 198/448

(58) Field of Search ..... 209/538, 539, 209/563–566, 592, 701, 912, 934, 576, 577; 198/448, 453, 454, 455, 502.1, 502.3

(56) References Cited

U.S. PATENT DOCUMENTS

| | | | | | |
|---|---|---|---|---|---|
| 2,610,748 | A | * | 9/1952 | Larham | 198/502.3 X |
| 2,753,975 | A | * | 7/1956 | Day et al. | 198/448 |
| 2,966,252 | A | * | 12/1960 | Meyer | 198/448 |
| 4,957,619 | A | * | 9/1990 | Powell, Jr. | 209/539 |
| 5,230,394 | A | * | 7/1993 | Blanc | 209/592 X |
| 5,497,887 | A | * | 3/1996 | Hiebert | 209/912 X |

* cited by examiner

*Primary Examiner*—Tuan N. Nguyen
(74) *Attorney, Agent, or Firm*—Anna M. Vradenburgh

(57) ABSTRACT

A multi-stream singulator has two continuously laterally adjacent streams of cups, which carry and advance articles to be graded to a discharge zone. Articles from the discharge zone are received onto a single stream grading conveyor. At least one of the streams of cups of the multi-stream singulator is a partial cup in advance of the other stream so that the items are discharged non-simultaneously at the discharge zone. Optical scanning of the articles is undertaken by a scanner scanning a zone of the singulating conveyor to determine a physical attribute of each article. Means are provided to associate the scanned attribute of each article from the singulating conveyor with its subsequent position on the single stream grading conveyor.

9 Claims, 2 Drawing Sheets

ARTICLE GRADING APPARATUS

This is a continuation of application Ser. No. 08/809,444, filed on Jun. 9, 1997, now abandoned, which is a 371 of PCT/NZ95/00113, filed Nov. 1, 1995.

TECHNICAL FIELD

This invention relates to article grading methods and apparatus and in particular but not solely to optical scanning methods and apparatus used in the grading and/or packaging of fruit and/or vegetables.

BACKGROUND ART

Apparatus for the grading of fruit is known which includes a fast moving single stream grading conveyor with an endless circuit of carriers or cups for holding individual items of fruit. It is known to pass the hit on the fast moving conveyor through an imaging zone, where while being rotated on the carriers or cups, the fruit are optically scanned to analyse for example the fruits' colour so that the fruit may for example be colour graded. It is also known to weigh each cup to ascertain the presence and, if present, the weight of items in each cup. This information may then be used to discharge the fruit carried by the individual cups into appropriate discharge lanes for packing.

Apparatus such as this has the disadvantage that for high speed operation the grading conveyor must move very rapidly and the scanning can produce blurred, fuzzy or less accurate images.

Apparatus for grading fruit is also known which has a multiple stream singulator for supplying fruit to the single stream grading conveyor. The multiple stream singulator has the desired effect of spreading fruit supplied to it in an even manner, such that fruit arriving at the single stream grading conveyor arrives in a fairly steady supply, and therefore the utilisation of the single stream grading conveyor, in terms of the number of filled cups per the total number of cups is higher than would be the case without the multiple stream singulator. However, currently known multiple stream singulators have advancing rows of effective cups delivering fruit to a discharge zone from where the fruit is then received by the grading conveyor, and each row of it on the singulator is delivered to the discharge zone simultaneously, and consequently the fruit arrives at the discharge conveyor in bunches. This has the disadvantage of not being a particularly steady flow.

DISCLOSURE OF INVENTION

It is therefore an object of the present invention to provide a method and/or apparatus for article grading which go some way towards overcoming the above disadvantages.

Accordingly in one aspect the invention consists in a method of scanning items to be graded which comprises

- presenting the items to be scanned and graded to a singulating means adapted to advance multiple streams of the items to a discharge zone,
- receiving onto a single stream grading conveyor from said discharge zone the discharged items of the multiple stream singulating means,
- scanning the multiple streams of the singulating means for at least one discernable characteristic of each item and feeding output signals from said scanning to discharge control means of said single stream grading conveyor and
- for each item associating said at least one discernable characteristic of said item with the position of said item on said single stream grading conveyor.

In a further aspect the invention consists in apparatus for scanning items to be graded comprising

- means to in use present the items to be scanned and graded to a singulating means adapted to advance multiple streams of the items to a discharge zone,
- means to receive onto a single stream grading conveyor from said discharge zone the discharged items of the multiple stream singulating means,
- means to scan the multiple streams of the singulating means for at least one discernable characteristic of each item and feed output signals from said scanning to discharge control means of said single stream grading conveyor and
- means to, for each item associate said at least one discernable characteristic of said item with the position of said item on said single stream grading conveyor.

In a still further aspect, the invention consists in a method of scanning items to be graded which comprises

- presenting the items to be scanned and graded to a singulating means adapted to advance multiple streams of the items to a discharge zone,
- receiving onto a single stream grading conveyor from said discharge zone the discharged items of the multiple stream singulating means,
- scanning the multiple streams of the singulating means for at least one discernable characteristic of each item and feeding output signals from said scanning to discharge control means of said single stream grading conveyor and
- ensuring between the discharge of the multiple stream singulating means at the discharge zone and the uptake from the discharge zone by said single stream grading conveyor a preservation of the sequence for the items determined during the scanning of the items.

In a still further aspect, the invention consists in apparatus for scanning items to be graded which comprises

- means to present the items to be scanned and graded to a singulating means adapted to advance multiple streams of the items to a discharge zone,
- means to receive onto a single stream grading conveyor from said discharge zone the discharged items of the multiple stream singulating means,
- means to scan the multiple streams of the singulating means for at least one discernable characteristic of each item and feed output signals from said scanning to discharge control means of said single stream grading conveyor and
- means to ensure between the discharge of the multiple stream singulating means at the discharge zone and the uptake from the discharge zone by said single stream grading conveyor a preservation of the sequence for the items determined during the scanning of the items.

In a still further aspect the invention consists in a multi-stream singulator comprising at least two streams of cups, at least one of said streams of cups being a partial cup in advance of the other streams of cups,

- such that concurrent advancement of said streams of cups to a discharge zone causes items carried on said cups of said at least one partially advanced stream to be discharged non-simultaneously with items carried on said cups of said other streams.

BRIEF DESCRIPTION OF DRAWINGS

One preferred form of the present invention will now be described with reference to the accompanying drawings in which.

MODES FOR CARRYING OUT THE INVENTION

Figure 1:
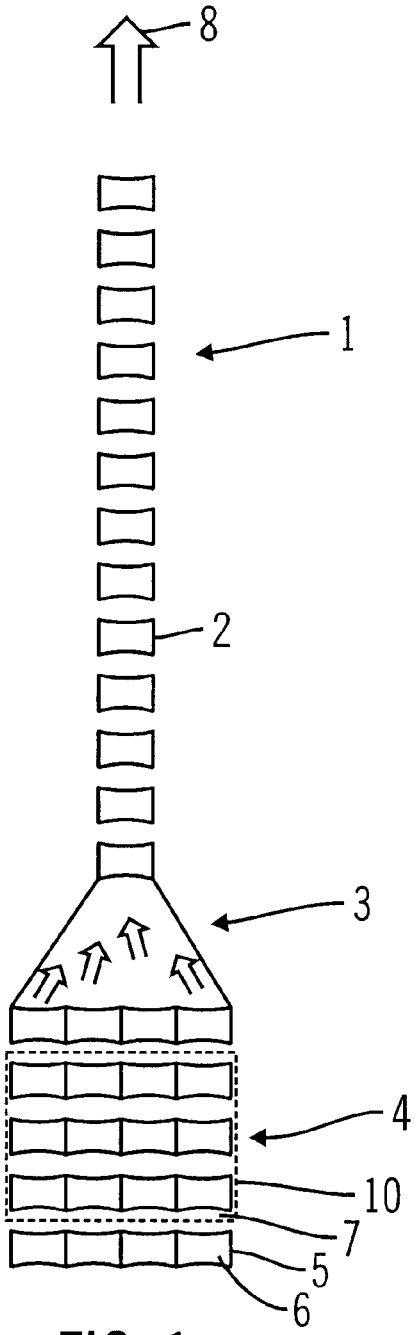
FIG. 1 is a plan elevation of a first form of the present invention.

With reference to FIG. 1, a plan elevation is shown of the relevant portion of apparatus for the grading of items, the apparatus shown is generally to be applied to fruit or vegetables, however items of other purpose may also be graded in the same manner. Single stream grading conveyor 1 is shown for movement of attached cups 2 in the direction of arrow 8. Attached cups 2 are preferably of the form shown and described in WO 94/14547. The preferred cups described in WO 94/14547 have a cup-like depression formed from a bow-tie roller on one side and an angled cross member on the other side. The cups are adapted to be individually actuable to discharge an item present in the cup-like depression to one or other sides of grading conveyor 1. The grading conveyor 1 receives fruit from singulator 4 via discharge zone 3. The singulator 4 has rotating shafts 5 with bow-tie rollers 6 mounted thereon, the shafts 5 attached to a chain conveyor (not shown), so that a conveyor is formed having multiple streams of effective cups 7, being the formed depressions between the forwardly adjacent rollers 6, the conveyor advancing the effective cups 7 to discharge zone 3. The rollers 6 are caused, over at least some of the length of the singulating conveyor, to rotate in either a forwards or a backwards direction. This may be achieved by either having the rollers 6 keyed, or otherwise non-rotatingly attached, to the shafts 5, and causing shafts 5 to rotate, for example by powering sprockets keyed to the shafts, or rotation of the rollers 6 may be achieved by having the rollers able to freely rotate relative to the shaft and causing each individual roller to rotate, for example by moving the rollers over a raised surface.

In use, items are presented to singulator 4, where the rotating rollers 6 cause items to become evenly distributed across the width of singulating means 4 in effective cups 7, such that practically all items rest individually in an individual effective cup 7. The process of singulation serves to distribute the presented items through the rotational movement of the rollers so that the items are distributed approximately entirely in to only one layer of items. The items in effective cups 7 are advanced by the advancement of the conveyor forming singulator 4 to discharge zone 3 where the items are discharged from the effective cups 7 into discharge zone 3. The items are then received by the cups 2 of single stream grading conveyor 1 whereon they are advanced in the direction of arrow 8 to eventually be discharged into discharge zones appropriate to each individual item as decided by a discharge control means.

Advantageously the configuration described allows, given similar spacing between forwardly adjacent rollers 6 of singulator 4 as between forwardly adjacent cups 2 of single steam grading conveyor 11 singulating means 4 is able to advance at a considerably lesser speed than grading conveyor 1, due to multiple rows feeding only one row.

Given that single stream grading conveyor 1 is advancing at a substantially faster speed the multiple stream singulator 4, it is preferable that the items, between being discharged at discharge zone 3 and being received at discharge zone 3 by the single stream grading conveyor, are accelerated to index the speed of travel of the items in discharge zone 3 with the speed of travel of the grading conveyor 1, at the point of reception by grading conveyor 1. A number of methods are apparent for the acceleration of items, for example the items may be permitted to accelerate by free travel down a sloping surface, the length and gradient of the surface being calculated to provide appropriate acceleration so that approximately the desired speed is obtained, or for example discharge zone 3 may include an armadillo plate conveyor, the plates of the conveyor being substantially overlapping at its singulator end, and becoming less overlapping closer to the grading conveyor end, such that in plates advancing from the singulator end to the grading conveyor end the plates face effective acceleration from an initial speed, and consequently any items thereon also undergo acceleration.

Figure 3:
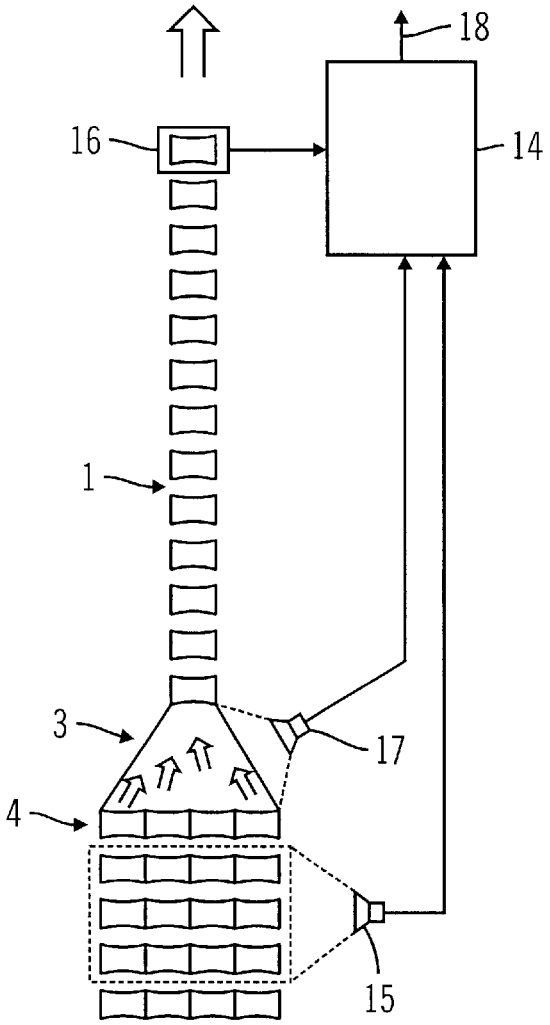
FIG. 3 is a schematic of the first form of the present invention including control system.
Figure 4:
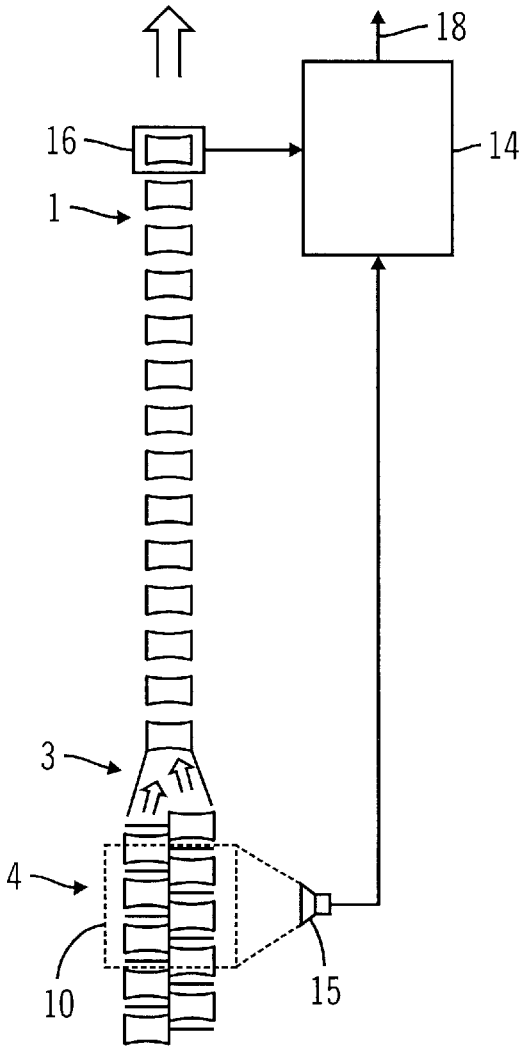
FIG. 4 is a schematic of the second form of the invention including control system.

Referring further to FIGS. 1, 3 and 4, the effective cups 7 of singulator 4, in advancing to discharge zone 3, pass through scanning zone 10. Scanning zone 10 may for example have a digital camera 15 taking sequential frames of the entire scanning zone. To these ends, given the rotation of the items on the singulating conveyor 4, the sequential frames taken by the camera 15 allow several views of each item, of different rotational aspects, to be taken as the item progresses from entry into scanning zone 10 to moving out of scanning zone 10. Other configurations for scanning zone 10 are possible, for example the zone may, rather than having only one camera covering the entire zone, have multiple cameras, each scanning a reduced section of the zone. Other forms of scanning device are also possible, for example the scanning device may involve use of ultrasound or could for example be an X-ray device.

The output of the camera or cameras or other optical scanning devices used in the scanning zone 10 is analysed to provide an indication of at least one discernable characteristic of each item on the singulating conveyor, the results of the analysis being fed to a discharge controller 14, which in the current form of the invention is for example a computer program, so that the discharge controller may make use of the indication of the discernable characteristic of each item in controlling, via output 18, the discharge of each item from the grading conveyor. With camera 15 as the scanning device, the discernable characteristic of each item would be a visually discernable characteristic, for example the colouring of each item, and the discharge of each item from the grading conveyor may be weighted according to the coloration of each item.

In order to be able to make use of the indication of the discernable characteristics of each item at the discharge control means, means for associating the discernable characteristic for an item with the item's position on the single stream grading conveyor, are provided. The means for associating may take a number of forms. For example, with reference to FIG. 3, video images may be taken by digital camera 17 of the discharge zone, at sufficient rate that items entering the discharge zone may be tracked through the discharge zone to their receipt onto single stream grading conveyor 1, the analysis of the tracking allowing mapping of a given item's position on singulating conveyor 4, and thereby the discernable characteristic of the item, to the item's position on single stream grading conveyor 1. Using this form of means for associating, it may be possible to give a direct indication of the exact cup onto which the item is received on single stream grading conveyor 1, or it might be preferable to determine only the relative order in which items are received by grading conveyor 1, the exact positions being determined by means to serially determine the position on the grading conveyor of each serially ranked item. Means for serially determining the position may for example be a weighing means 16, the weighing means 16 weighing each individual cup, and thereby ascertaining the presence or absence of an item thereon and thereby allowing association of the next ranked item of the series to be associated with the cup.

Figure 2:
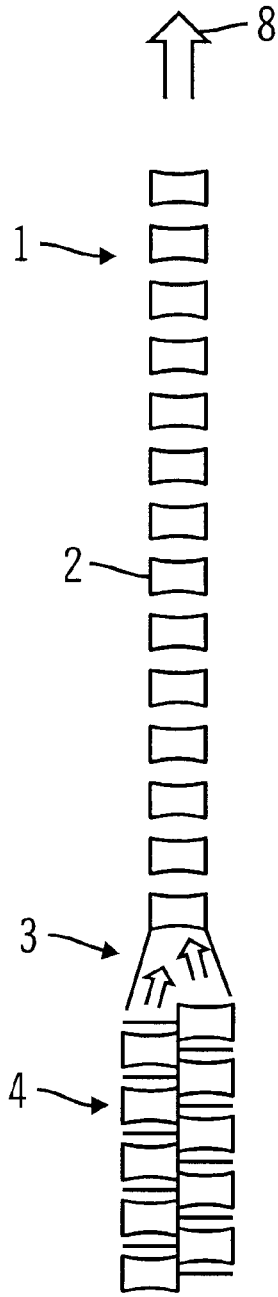
FIG. 2 is a plan elevation of a second form of the present invention

Another form of means for associating is depicted in FIG. 2. It can be seen in FIG. 2 that the multiple streams of the singulator 4 are staggered, so that rather than multiple items arriving at discharge zone 3 simultaneously, the items arrive at discharge zone 3 serially, the series being preserved through the discharge zone, and therefore onto grading conveyor 1. In a similar manner to that for the imaging technique described above the use of means to serially determine the position on the grading conveyor of the items may be used to associate the discernable characteristic of each item with the item's position on the grading conveyor.

The form of singulating means shown in FIG. 2 has the further advantage that items are not discharged from the singulating means to the discharge zone simultaneously, and therefore a more steady stream of items arrives at grading conveyor 1. It is considered that such a singulator is advantageous, and may be used in grading apparatus with or without the inclusion of scanning of items while on the singulator. In this form of the singulator, rollers 6 are provided on shafts 5 with approximately single roller spacings laterally provided between adjacent rollers on each shaft, so that the shaft may, when assembled to form a conveyor, form a series of laterally adjacent streams, each stream partially advanced (or partially delayed) compared to its laterally adjacent streams by approximately half a cup period.

Therefore it can be seen from the above description that imaging of the items on the singulating conveyor provides the significant advantage that the items are travelling at a significantly slower speed and therefore blurring and fuzzing of images is reduced. Also, the high density of items on the singulating conveyor allows a single camera view to cover a larger number of items with each shot, and thereby it is possible to reduce the wastage of processor time in analysing redundant portions of an image.

What is claimed is:

1. A multi-stream singulator, comprising at least two continuously laterally adjacent streams of cups, each of said cups being rotated so that a plurality of items received by said streams of cups are singulated by the rotation of said cups and movement of said items within and across said streams of cups into each of said cups, at least one of said stream of cups being a partial cup in advance of the other stream of cups, such that concurrent advancement of said laterally adjacent streams of cups to a discharge zone causes said items carried on said cups of said partially advance stream to be discharged from the multi-stream singulator at the discharge zone non-simultaneously with items carried on said cups of said other streams.

2. A multi-stream singulator according to claim 1 having at least two streams of bow-tie rollers and forwardly adjacent said bow-tie rollers form a cup therebetween.

3. A multi-stream singulator according to claim 1 wherein each stream is partially advanced relative to its laterally adjacent stream by approximately half a cup period.

4. A multi-stream singulator according to claim 1 and further including apparatus for scanning items to be graded including:

means to receive onto a single stream grading conveyor from said discharge zone the discharged items of the multi-stream singulator;

means to scan the multiple streams of the multi-stream singulator for at least one discernable characteristic of each item and feed output signals from said scanning to discharge control means of said single stream grading conveyor; and means to, for each item, associate said at least one discernable characteristic of said item with the position of said item on said single stream grading conveyor.

5. A multi-stream singulator according to claim 4 wherein said scanning is optical scanning and said at least one discernable characteristic is at least a visually discernable characteristic.

6. A multi-stream singulator according to claim 5 wherein said apparatus further includes means to advance said multiple streams to said discharge zone such that items serially enter said discharge zone in a predetermined order, means to maintain said predetermined order through said discharge zone, and means to receive said items onto said discharge conveyor in said predetermined order.

7. A multi-stream singulator according to claim 6 wherein said apparatus includes means to optically scan said discharge zone, means to use said optical scanning to track items through said zone and means to determined the order in which said items are received onto said grading conveyor from the tracking of said items.

8. A multi-stream singulator according to claim 5 wherein said apparatus further includes means to serially weigh the items on said grading conveyor, the timing of said serial weighing indicating the relative spacing of positions in said series and means to determine the position on said grading conveyor of each item from said timing.

9. A multi-stream singulator according to claim 5 wherein said apparatus further includes means to accelerate said items in said discharge zone in order to index the speed of said items at the interface between said discharge zone and said grading conveyor to the speed of said grading conveyor.

* * * * *